BEST AVAILABLE COP'

United States Patent [19]

Tak

[11] Patent Number: 4,875,579

[45] Date of Patent: Oct. 24, 1989

[54] PORTABLE CONTAINER ASSEMBLY FOR CONTAINING GOLF ACCESSORIES

[76] Inventor: Seung W. Tak, 42 Auburn Rd., West Hartford, Conn. 06119

[21] Appl. No.: 224,676

[22] Filed: Jul. 27, 1988

[51] Int. Cl.[4] ..... A63B 57/00; A63B 55/02

[52] U.S. Cl. ..... 206/315.1; 206/315.9; 206/579; 224/274; 224/918; 224/919; 273/32 R; 273/32 D; 368/10

[58] Field of Search ..... 224/918, 919, 274; 273/32 R, 32 D; 368/3, 10; 206/315.1, 315.2, 315.9, 315.6, 545; 220/903, 902; 215/12.1

[56] References Cited

U.S. PATENT DOCUMENTS

| | | | |
|---|---|---|---|
| 715,759 | 12/1902 | Crane | 206/315.9 |
| 1,421,955 | 7/1922 | Kemp | 206/315.9 |
| 1,648,565 | 11/1927 | Primley | 206/315.9 |
| 1,722,134 | 7/1929 | Fredette | 206/315.9 |
| 1,754,495 | 4/1930 | Anderson | 206/315.9 |
| 1,810,491 | 6/1931 | McClure | 224/919 X |
| 1,973,819 | 9/1934 | Link | 206/315.5 X |
| 2,024,484 | 12/1935 | Smith | 224/919 X |
| 2,073,328 | 3/1937 | Wasserlein, Sr. | 206/315.1 X |
| 2,521,573 | 9/1950 | Filler et al. | 206/315.5 X |
| 2,536,725 | 1/1951 | Cleveland | 206/315.5 |
| 2,555,788 | 6/1951 | Donaldson | 206/545 |
| 2,731,182 | 1/1956 | Higgins | 215/12.1 X |
| 2,747,768 | 5/1956 | Raines | 206/315.1 X |
| 2,768,775 | 10/1956 | Houser | 224/918 X |
| 2,950,748 | 8/1960 | Olinghouse | 206/315.9 X |
| 3,119,533 | 1/1964 | Kimes et al. | 224/274 |
| 3,128,021 | 4/1964 | Habbena | 224/274 |
| 3,186,593 | 6/1965 | Miotke | 273/32 D X |
| 3,547,314 | 12/1970 | Brandell | 273/32 D |
| 3,753,519 | 8/1973 | Gammon | 206/315.1 X |
| 3,799,331 | 3/1974 | White | 206/315.1 X |
| 3,844,459 | 10/1974 | Chambers | 224/274 |
| 3,899,098 | 8/1975 | Hutchins | 220/903 X |
| 3,902,634 | 9/1975 | Bromley et al. | 206/315.1 X |
| 3,941,398 | 3/1976 | Nelson | 206/315.6 X |
| 4,082,209 | 4/2978 | Sanders | 224/918 X |
| 4,245,684 | 1/1981 | Street et al. | 206/315.6 X |
| 4,282,912 | 8/1981 | Brown | 206/315.5 |
| 4,317,477 | 3/1982 | Baptista | 206/315.2 X |
| 4,319,616 | 3/1982 | Light | 206/315.2 |
| 4,339,120 | 7/1982 | Czarny | 224/919 X |
| 4,350,194 | 9/1982 | Brown | 206/315.5 |
| 4,383,563 | 5/1983 | Kirchhoff, Jr. | 206/315.5 X |
| 4,449,310 | 5/1984 | Kline | 206/315.5 X |
| 4,459,827 | 7/1984 | Rhodes | 224/919 X |
| 4,573,610 | 3/1986 | Hurner | 224/918 X |
| 4,575,092 | 3/1986 | Watson | 273/32 D X |
| 4,629,202 | 12/1986 | Nelson et al. | 206/315.2 X |
| 4,657,135 | 4/1987 | Kjose | 206/315.5 X |
| 4,730,728 | 3/1988 | Larkin | 206/315.9 |
| 4,753,446 | 6/1988 | Mills | 206/315.6 X |

FOREIGN PATENT DOCUMENTS

| | | | |
|---|---|---|---|
| 1161875 | 2/1984 | Canada | 224/919 |
| 272001 | 6/1988 | European Pat. Off. | 273/32 D |
| 1314020 | 4/1973 | United Kingdom | 206/545 |

*Primary Examiner*—Sue A. Weaver

*Attorney, Agent, or Firm*—Birch, Stewart, Kolasch & Birch

[57] ABSTRACT

A golf accessory carrier includes a drink can jar, a golf ball holding cylinder, a golf tee holding cylinder, a golf marking pencil holding cylinder disposed therein, and an attaching member mounted thereto for attaching the golf accessory carrier to the golf bag.

11 Claims, 2 Drawing Sheets

BEST AVAILABLE COPY

BEST AVAILABLE COP'

BEST AVAILABLE COPY

PORTABLE CONTAINER ASSEMBLY FOR CONTAINING GOLF ACCESSORIES

BACKGROUND OF THE INVENTION

1. Field of the Invention

The present invention relates to a portable container for handling golf accessories and golfer's suppliers and more particularly, to an article carrier for drink cans, a digital watch, golf balls, golf tees, a golf marking pencil, and the like, which is capable of being attached to a golf bag so that these articles can be conveniently utilized by the golfer as he moves about the golf course. The articles such as drink cans, golf balls, and golf tees in the gold accessory carrier of the present invention are readily and easily supplied from the carrier.

2. Prior Art of the Invention

Many types of devices for handling golf accessories and golfer's suppliers are known in the art. For example, (a) golf clips including spring-like material are adapted to be resiliently and removably mounted to the rim of a golf bag. Such golf clips are shown in U.S. Pat. Nos. 715,759, 1,648,565, 1,973,819, 2,536,725, 3,753,519, 4,449,310, and 4,730,728. However, since such gold clips are small in size, many heavy drink cans cannot be carried therein. (b) Golfer's pocket kits which are permanently attached to the golf bag are shown in U.S. Pat. Nos. 3,799,331, 4,282,912, 4,350,194, 4,383,563, 4,657,135, and 4,753,446. However, such golfer's pocket kits are small in size and golfer's supplies and golf accessories in said golfer's pocket kits are all mixed up. On the other hand, such golfer's pocket kits do not disclose the use of an assembly in proper combination with the golfer's suppliers and golf accessories. (c) Golf club carriers containing a plurality of chambers disposed therein for accommodating golf accessories and golfer's supplies are shown in U.S. Pat. Nos. 2,521,573, 4,245,684, 4,317,477, 4,319,616, and 4,629,202. However, since such golf club carriers disclose that the use of chambers for carrying golf accessories and golfer's suppliers are formed in the interior of golf carriers, it is very difficult and takes time for the user to remove the articles from the chambers of such golf club carriers.

SUMMARY OF THE INVENTION

Accordingly, it is an object of the present invention to provide an improved portable container for accommodating drink cans, a digital watch, and golf accessories, which is attachable to or detachable from the golf bag.

Another object of the present invention is to provide a portable golf accessory carrier which includes a golf ball holding cylinder for effectively holding a plurality of golf balls and dispensing them, one by one.

A further object of the present invention is to provide a portable golf accessory carrier which includes a golf tee holding cylinder for effectively accommodating a plurality of golf tees which contains a pair of collars having a plurality of resilient fingers, disposed at both end portions of the cylindrical holding member for individually supplying golf tees, one by one.

Still another object of the present invention is to provide a portable assembly in combination with golf accessories and golfer's supplies which is simple in construction and relatively inexpensive to manufacture.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly, the present invention relates to a portable golf accessory carrier which includes a golf ball holding cylinder having a golf ball holder, a golf tee holding cylinder having a pair of collars with a plurality of resilient fingers, and a drink can jar having a can lifting member, a golf marking pencil holder disposed therein, a digital watch, and attachments disposed thereon, whereby the golf accessory carrier supplies golf accessories and golf supplies to the golfer while he moves about the golf course.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
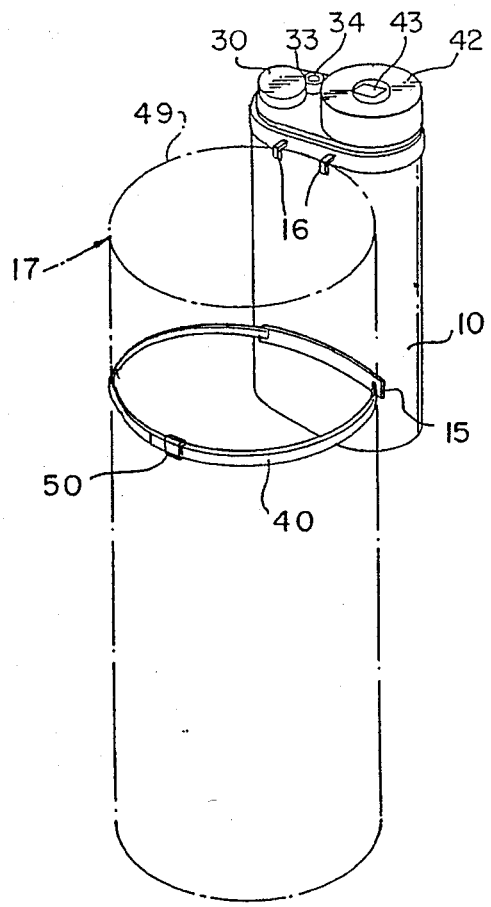
FIG. 1 is a perspective view of a portable container for golf accessories according to the present invention which is attached to a golf bag.
Figure 3:
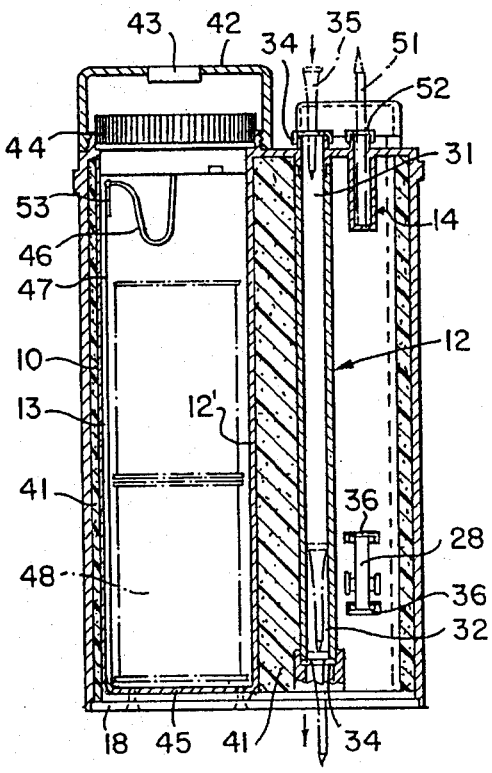
FIG. 3 is a sectional view of the portable container for golf accessories as defined by the present invention showing a drink can jar, a golf ball holding cylinder, and a golf tee holding cylinder.
Figure 2:
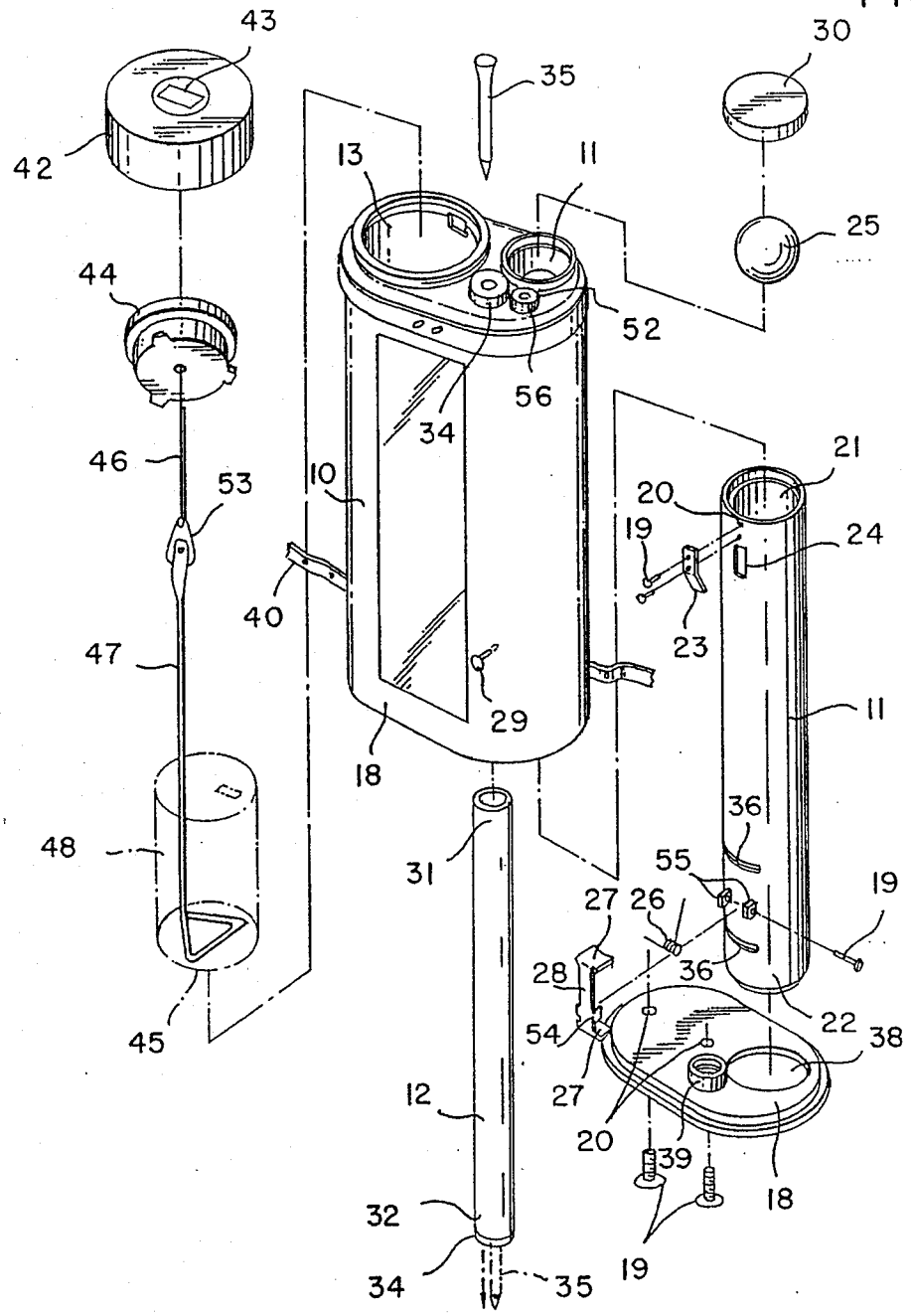
FIG. 2 is an exploded, perspective view of the portable container for accommodating golf accessories as defined by the present invention.

Referring now in detail to the drawings for the purpose of illustrating preferred embodiments of the present invention, the golf accessory carrier as shown in FIGS. 1, 2 and 3 comprises a body member 10 and a carrier cap 18. The body member 10 includes a golf ball holding cylinder 11, a golf tee holding cylinder 12, a drink can jar 13, and a golf marking pencil holding cylinder 14 disposed in the top of the golf tee holding cylinder. The golf accessory carrier further comprises a pair of hooks 16 secured to the upper wall thereof for attaching the gold accessory carrier to a rim 49 of a golf bag 17 and a smooth sheath 15 secured to the middle wall thereof for receiving a band 40 which has a suitable buckle 50 or other fastening member by which the carrier is secured around the golf bag 17.

The golf ball holding cylinder 11 disposed in an elongated hole 11' of the body member 10 contains a cap 30, a spring aperture 24 adjacent to an inlet portion 21 thereof for receiving a bias spring 23 which is secured by bolts 19 through apertures 20. The bias spring 23 is used to hold a golf ball 25 within the golf ball holding cylinder 11. Also, the golf ball holding cylinder 11 is provided with a pair of ball holder apertures 36 adjacent to an outlet portion 22 thereof for receiving both end

Figure 4:
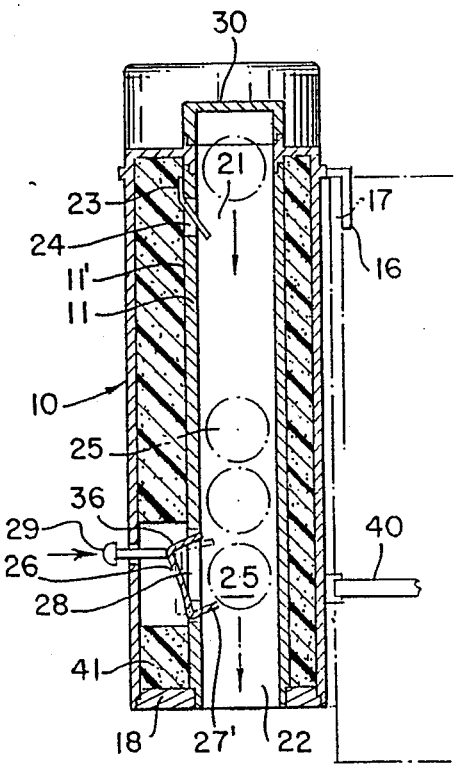
FIG. 4 is a sectional view of the golf ball holding cylinder containing a golf ball holder with a torsion spring of the present invention.

BEST AVAILABLE portions 27 and 27' of a C-shaped gold ball holder 28 (FIG. 4). The ball holder 28 is provided with a pivotal raised portion disposed at about two thirds distance from an upper portion toward a lower portion of the ball holder which has pivotal aperture 54 eccentrically disposed at the raised portion. The ball holder 28 containing a torsion spring 26 is pivotally secured to a pair of attaching apertures 55 disposed between the pair of ball holder apertures 36 by a bolt 19. As shown in FIG. 4, the ball holder 28 defining an upper end with an upper corner at the upper portion and an lower end with a lower corner at the lower portion is provided with a button 29 attached to the upper corner thereof, whereby when the button 29 is pushed, the ball 25 is readily released to separate from the ball holding cylinder 11 since the pivotal raised portion is located at about two thirds of the distance from the upper portion toward the lower portion of the ball holder 28, and in turn, when the button 29 is not actuated, the ball 25 is held in the ball holder 28 by the biased force of the torsion spring 26 associated with the ball holder 28.

Figure 5:
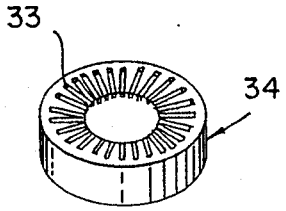
FIG. 5 is a perspective view of a collar having a plurality of resilient fingers according to the present invention.
Figure 6:
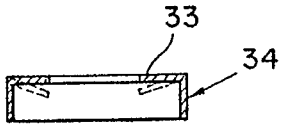
FIG. 6 is a sectional view of the collar of FIG. 5.

As shown in FIGS. 2, 5 and 6, the golf tee holding cylinder 12 is provided with a pair of collars 34 of which one is attached at each end 31 and 32 thereof for holding a plurality of golf tees 35. Since the collar 34 contains a plurality of resilient inwardly extending flexible fingers 33, the fingers 33 grip and keep the golf tee 35 in the golf tee holding cylinder 12. That is, the fingers 34 adjacent to an inlet end 31 of the golf tee holding cylinder 12 retain the golf tees 35 and the fingers 34 disposed adjacent to an outlet end 32 of the golf tee holding cylinder 12 grip the tee body of the golf tee 35 at the portion under the tee head. Also, since the fingers 33 are made of a resilient material such as a plastic, a rubber, or the like, the golf tee 35 is easily separated from the collar 34 adjacent to the outlet end 32 by pulling the tee body (FIG. 6).

As shown in FIGS. 2 and 3, the drink can jar 13 is provided with an outer cap 42 having a digital watch 43 disposed on the top thereof, an inter cap 44, and an insulation material layer 41 for surrounding the drink can jar 13 to insulate the drink cans 48 in the can jar 13. The inter cap 44 is provided with a string 46 attached thereto. A rigid lifting rod 47 connected to the strip 46 through a connecting member 53 extends to a triangular support member 45 for supporting the drink can 48 on the triangular support member 45 so that the drink can can be lifted by lifting the rigid lifting rod 47 and triangular support member 45 from the drink can jar 13.

The golf marking pencil holding cylinder 14 is provided with a cap 52 having a plurality of resilient inwardly extending flexible fingers 33 which grip and hold the golf marking pencil 51 (FIGS. 2 and 3).

As shown in FIG. 2, the carrier cap 18 includes a large circular aperture 38 for receiving the golf ball holding cylinder 11, a small circular aperture 39 for receiving the golf tee holding cylinder 12, and a plurality of apertures 20 for screwingly receiving bolts 19 to attaching the carrier cap 18 to the body member 10.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A portable container for accommodating golf accessories, which is capable of being attached to a golf bag which comprises:

a body member, said body member defining a first elongated chamber, a second elongated chamber, a third elongated chamber, and a fourth elongated chamber disposed therein, a golf ball holding cylinder disposed in said first elongated chamber, golf ball holding means operatively provided at a lower end of the golf ball holding cylinder for holding golf balls within the golf ball holding cylinder or selectively releasing the golf balls from said golf ball holding cylinder, one by one, a golf tee holding cylinder disposed in said second elongated chamber, said golf tee holding cylinder being provided with a collar at each end thereof, said collars including means for holding and selectively removing golf tees from said golf tee holding cylinder, one by one, a golf marking pencil holding cylinder disposed in said third elongated chamber, said golf marking pencil holding cylinder being provided with a collar cap at a top end thereof, said collar cap including means for gripping said golf marking pencil, a drink can jar disposed in said fourth elongated chamber for holding drink cans, said drink can jar being provided with an outer cap and an inner cap connected to a rigid lifting member for lifting the drink cans, one by one, a body member cap attached to said body member, said body member cap including large and small circular apertures for receiving said golf ball holding cylinder and said golf tee holding cylinder, respectively, a digital watch disposed at a top of said outer cap, and attaching means for attaching or detaching said portable container to said golf bag.

2. The portable container of claim 1, wherein the golf ball holding cylinder includes a cap and a bias spring for retaining the golf balls therewithin.

3. The portable container of claim 1, wherein the ball holding means includes with a torsion spring disposed in said pivotal point for readily keeping the golf ball in the holding means until an upper end of the generally C-shaped holding means is pushed against the bias of the torsion spring by a button which is attached to the upper end.

4. The portable container of claim 1, wherein the means for holding golf tees includes fingers on the collars of the golf tee holding cylinder and means for gripping the pencil includes fingers on the collar cap of the golf marking pencil cylinder being made of a resilient material.

5. The portable container of claim 4, wherein the resilient material is a plastic.

6. The portable container of claim 4, wherein the resilient material is a rubber.

7. The portable container of claim 1, wherein the rigid lifting member contains a triangular support member for supporting the drink can thereon.

8. The portable container of claim 1, wherein the attaching means is provided with a pair of hooks secured to an upper portion of said body member for attaching to a rim of the golf bag, and a smooth sheath secured to a middle portion of said body member for receiving a band by which the portable container is secured around the golf bag.

9. The portable container of claim 8, wherein the band has a buckle for fastening the band.

10. The portable container of claim 1, wherein a pair of apertures are disposed in the lower portion of the golf ball holding cylinder and the golf ball holding means is pivotally disposed to selectively extend through said pair of apertures into the golf ball holding cylinder for releasing golf balls therefrom.

11. The portable container of claim 10, wherein the ball holding means has a C-shaped configuration with an upper arm and a lower arm, said ball holding means being mounted to pivot around a pivot point disposed one third of the distance from the lower arm.

* * * * *